United States Patent [19]

Franks, Jr.

[11] 4,330,377

[45] * May 18, 1982

[54] ELECTROLYTIC PROCESS FOR THE PRODUCTION OF TIN AND TIN PRODUCTS

[75] Inventor: John A. Franks, Jr., Vermilion, Ohio

[73] Assignee: Vulcan Materials Company, Birmingham, Ala.

[ * ] Notice: The portion of the term of this patent subsequent to Nov. 18, 1997, has been disclaimed.

[21] Appl. No.: 168,254

[22] Filed: Jul. 10, 1980

[51] Int. Cl.[3] ..... C25G 1/24; C25C 1/14

[52] U.S. Cl. ..... 204/93; 204/94; 204/120; 204/122; 203/39; 210/660; 210/663; 210/664

[58] Field of Search ..... 204/120–122, 204/86, 93, 94; 210/660, 663, 664; 203/39

[56] References Cited

U.S. PATENT DOCUMENTS

| | | | |
|---|---|---|---|
| 3,795,595 | 3/1974 | Wilson | 204/86 |
| 4,066,518 | 1/1978 | Horn | 204/86 |
| 4,118,293 | 10/1978 | Ruf et al. | 204/93 |
| 4,234,393 | 11/1980 | Hepworth et al. | 204/86 |
| 4,234,403 | 11/1980 | Franks, Jr. | 204/94 |

*Primary Examiner*—R. L. Andrews

*Attorney, Agent, or Firm*—Burns, Doane, Swecker & Mathis

[57] ABSTRACT

Tin ions are provided to the electrolyte-containing cathode compartment of an electrolysis cell in which the anode and cathode compartments are separated by a cationic permselective membrane. The anolyte is generally a mineral acid or tin salt thereof. Operation of the electrolysis cell results in the deposition of tin in a purified form onto the catode which may be recovered as tin metal. Alternatively, the deposited tin and cathode compartment can be washed and the cathode compartment filled with an acid solution. Reversal of the current polarity results in the production of tin salts which may be recovered. Tin salts may also be concurrently anodically produced while tin metal is cathodically electrowinned.

30 Claims, 2 Drawing Figures

ELECTROLYTIC PROCESS FOR THE PRODUCTION OF TIN AND TIN PRODUCTS

BACKGROUND OF THE INVENTION

It is known to produce tin from tin salts, e.g., stannic chloride, in an electrolytic or a divided cell (divided by a permeable, e.g., asbestos or glass fiber diaphragm) using an acidified stannic chloride electrolyte or by introducing a stannic chloride solution into the cathode compartment of the cell and a hydrochloric acid or sulfuric acid solution into the anode compartment of the cell. When direct current is imposed, tin metal is deposited on the cathode. See, for example, U.S. Pat. Nos. 2,250,843; 2,253,865; 1,124,315; 883,139; 883,141; 704,675; 699,012; and 874,707.

Electrolytic cells using a porous diaphragm, e.g., an asbestos type diaphragm, permit the flow of electrolyte solution from one electrode compartment to another which flow may cause contamination. In addition, such cells have low current efficiencies and relatively low yield of tin metal.

In contrast to known fluid permeable membranes, ion permselective membranes, also referred to as ion exchange membranes, have been found useful in a variety of fluid purification applications. One specific use is the demineralization of water. Other specific uses include the treatment of pickling liquors to produce sulfuric acid and electrolytic iron, the treatment of copper or leaching solutions to produce hydrochloric acid and copper and the purification of aluminum sulfate solutions by electrolytically depositing iron therefrom. See, Industrial & Engineering Chemistry, Vol. 54, No. 6, page 29 (June 1962) and U.S. Pat. Nos. 3,537,961, 3,347,761 and 3,787,293. In addition, cationic permselective membranes have been disclosed for use in processes to produce stannic oxide sol products (see U.S. Pat. No. 3,723,273), anionic permselective membranes have been disclosed for use in a process to form tin and lead salts, e.g., stannous sulfate (see U.S. Pat. No. 3,795,595), cationic permselective membranes have been suggested for use in the regeneration and recycling of chromium etching solutions, see Chemical Engineering, June 4, 1979, page 77, and cationic permselective membranes have been disclosed for use in a process to form stannous salts from stannic anions (see my copending application Ser. No. 48,829, filed June 15, 1979).

A number of the known uses for tin and/or tin salts result in the formation of residual tin-containing values such as, for example, glass plant sludge, blue sludge, detinning mud, spend plating baths, spent catalyst systems, drosses, ores, ore residues and the like, which contain not only tin but disparate other metals and/or organic impurities. Since the price of tin has continued to increase, these residua have become increasingly more valuable. While numerous attempts have been made to economically recover the tin values therefrom, most if not all of the attempted processes have been expensive, cumbersome or have relatively low yields.

OBJECTS AND SUMMARY OF THE INVENTION

It is an object of the present invention to provide for the electrolytic production of tin and tin salt-containing solutions using cationic permselective membranes without incurring or substantially alleviating the problems heretofore associated with the production of such solutions.

Another object of the present invention is to provide an electrolytic process for the production of tin and stannous salts using cationic permselective membranes.

Yet another object of the present invention is to provide an electrolytic process for the production of purified tin from tin salt- and impurity-containing solutions.

Still another object of the present invention is to provide an electrolytic process which may be used in a recycle process to provide a stannous salt containing solution from a tin salt- or tin acid-containing solution.

In accordance with one aspect of the present invention there is provided an electrolytic process for the production of tin or tin salts in an electrolytic cell, comprising an anode compartment and a cathode compartment, each compartment containing an electrolyte solution, and a cationic permselective barrier between the anode and cathode compartments comprising introducing a soluble tin salt or tin acid into the cathode compartment of the electrolytic cell, applying direct current to the anode and cathode to produce tin on the cathode in the cathode compartment while substantially simultaneously preventing migration of anions between the cathode and anode compartments and allowing migration of protons from the anode to cathode compartments by maintaining an electrolyte fluid impermeable cationic permselective barrier between the anode and cathode, removing produced gas from the anode compartment and removing the tin or tin salts from the cathode compartment.

In another embodiment of the present invention there is provided an electrolytic process for the production of stannous chloride or stannous sulfate utilizing an electrolytic cell comprising a cathode and an anode and an ion permselective barrier dividing the electrolytic cell into anode and cathode compartments which process comprises providing a mixture of stannic and chloride ions having a chloride to tin ratio of at least about 4:1 in the cathode compartment, providing a mineral acid solution in the cathode compartment, applying direct current to the anode and cathode to form tin which is deposited on the cathode and substantially preventing migration of stannous and/or stannic ions from the cathode compartment to the anode compartment while simultaneously allowing migration of protons from the anode to cathode compartments by maintaining a cationic permselective barrier between the anode and cathode, removing the spent catholyte solution from the cathode compartment, introducing a hydrochloric acid or sulfuric acid solution into the said cathode compartment and applying direct current to the said anode and cathode compartments in opposite polarity from that previously applied to form stannous chloride or stannous sulfate.

The present invention is applicable to starting solutions which contain stannic ions, stannous ions or mixtures thereof. It has been found that stannous ion or stannic ion solutions containing an excess of acid moieties form stannic and/or stannous anions in solution which are substantially prevented from passing from the cathode compartment to the anode compartment in the electrolytic cell by the cationic permselective membrane. As the tin ions are reduced to tin metal which is deposited on the cathode, further acid moieties are also produced which increase the formation of the anionic complexes because of the equilibrium constants of the various ions which are produced in the cathode compartment. The operation of the present process forms further free acid and thus more strongly shifts the equilibrium in favor of the formation of the anionic complexes. Protons are transferred through the cationic permselective membrane from the anode into one cathode compartment thus preserving the stoichiometry of the electrolytic reaction. In addition, it has been found desireable to remove the gases which are produced in the anolyte solution during electrowinning of the tin metal, e.g., oxygen, chlorine and/or mixtures. As the tin is plated onto the cathode, small quantities of hydrogen gas are also liberated in the cathode compartment. The hydrogen apparently passivates the metal surface rendering it unreactive to the acidic catholyte.

The tin metal may be recovered from the cathode for use in any manner in which tin metal is used or, advantageously, may be used to form tin salts (or tin compounds) by replacing the spent catholyte with a new or purified acid solution and reversing the electric current thereby forming the tin salt.

The process of the present invention may be effectively used to purify tin-containing materials of impurities such as iron and titanium as well as various other metallic, inorganic and/or organic materials. The process of the present invention can be used to recover at least 95, preferably at least 98, most preferably at least 99, percent of the tin values and at high current efficiencies of usually about 80% or more.

DESCRIPTION OF THE PREFERRED EMBODIMENTS

Figure 1:
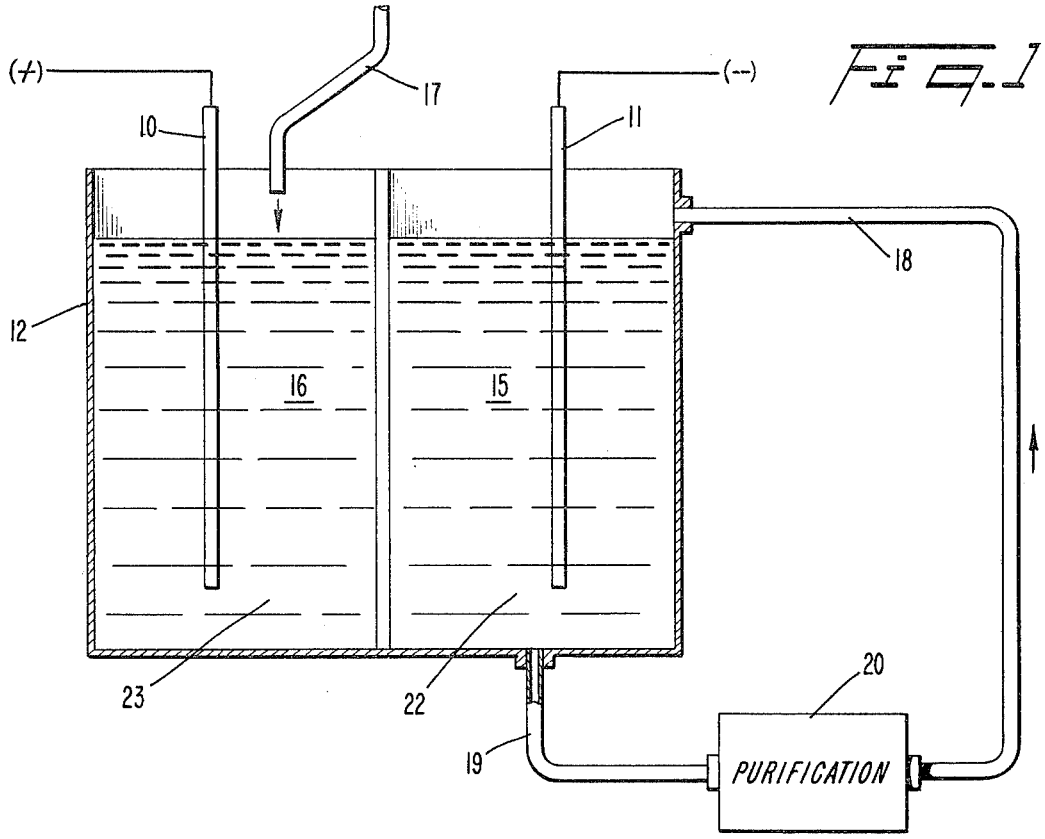
FIG. 1 is a schematic representation of an electrolytic cell used in the process of the present invention.

FIG. 1 shows a representation of an electrolytic cell which may be utilized in the process of the present invention. This cell comprises an anode 10 and a cathode 11 within an electrolytic cell 12. A cationic permselective membrane 13 is disposed to separate the anode compartment 23 and cathode compartment 22 of the electrolytic cell 12. The cationic permselective membrane 13 extends the depth of the electrolytic cell 12. The cathode compartment 22 of the electrolytic cell 12 contains a catholyte solution 15 which initially contains the tin ion solution as further described hereinafter. The anode compartment 23 of the electrolytic cell 12 contains an anolyte solution 16 which can be of any suitable, non-deleterious acid or acid salt electrolyte solution as also further described hereinafter. The anode compartment 23 further contains a vacuum tube 17 or other means for removing gases which are produced within the anode compartment during the operation thereof. A similar vacuum tube (not shown) may also be disposed in the cathode compartment 22. If desired, the electrolytic cell 12 can also contain a stirrer or other means for agitating or circulating the solution (not shown) and a thermo-couple for obtaining the temperature of the solution (not shown). The electrolytic cell also contains suitable connections 18 and 19 for the addition of and removal of the catholyte solution 15 from the electrolytic cell 12. The catholyte solution may be removed to a purification treatment (generally indicated as 20) and recycled via connection 18 as explained hereinafter.

The anode 10 and cathode 11 are connected to a suitable source of direct current power source at their terminals. Heating or cooling means may also be provided to maintain the anolyte and the catholyte at the desired operating temperatures.

The anode and cathode may be of any convenient shape such as a sheet or rod and the overall size of the anode, the cathode and the respective compartments may be varied according to the particular style of operation. Any type of anode and cathode material that is electrically conductive and has low reactivity in electrolyte solution, i.e., is substantially inert to the electrolyte, may be used. For example, carbon and platinum have been found to be suitable. Other suitable materials may also be utilized. In certain embodiments of the present invention as descrbed hereinbelow, it may also be possible to utilize a tin (or tin scrap) cathode and/or anode.

Multiple cell operations, i.e., anode compartments interposed between cathode compartments, may also be utilized.

Figure 2:
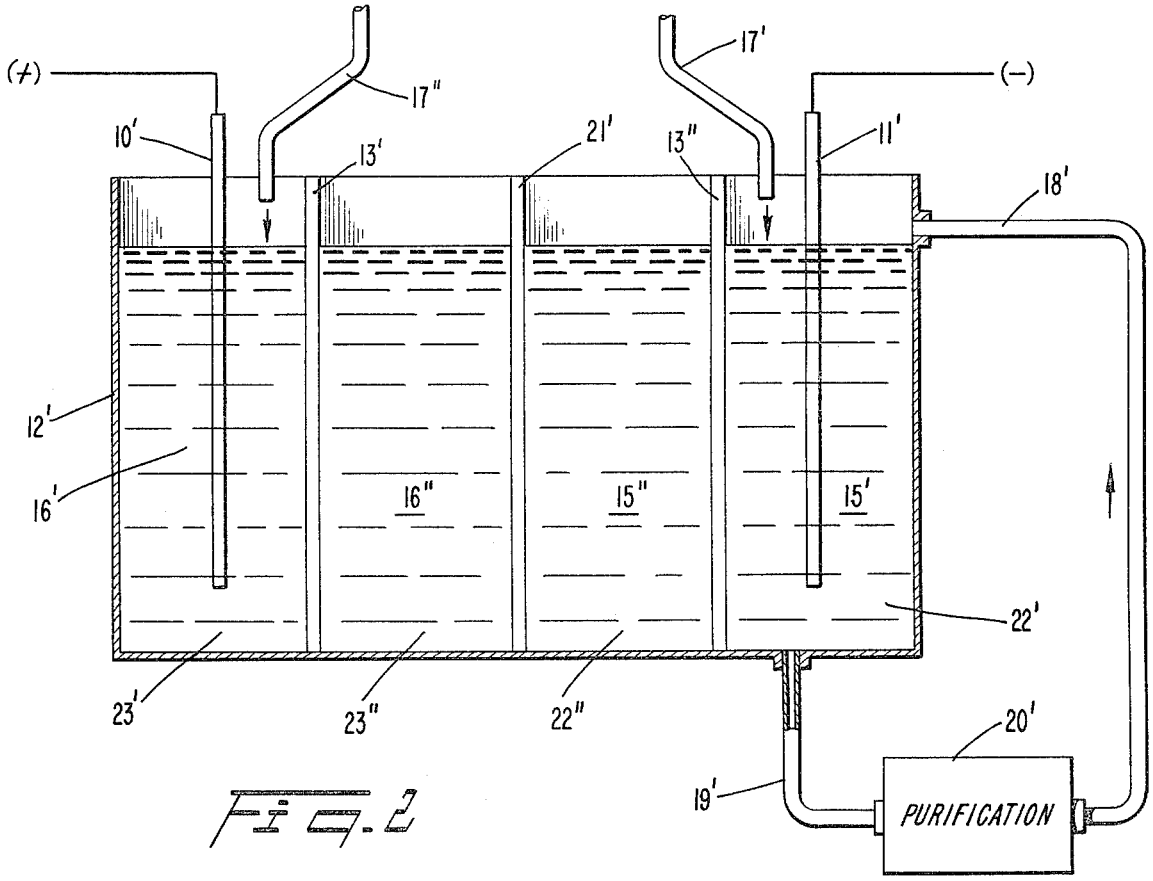
FIG. 2 is a schematic representation of an electrolytic cell used in another embodiment of the process of the present invention.

FIG. 2 shows an electrolytic cell which as described hereinafter is particularly suited for the production of stannous sulfate or other tin salts which form cations in acid solution. In this figure, all components which are the same as described above with respect to FIG. 1 are given the same but primed numerals. In this embodiment, two cationic permselective membranes 13', 13'' are utilized in the electrolytic cell 12' separated by an anionic permselective membrane 21' forming cathode compartments 15' and 15'' and anode compartments 16' and 16''. Vacuum tubes 17' and 17'' are disposed in compartments 23' and 22', respectively.

The electrolytic cell may be operated at an anode current densities at from about 5 to 200 or more amperes per square foot of anode area (the upper limit being determined generally by the upper limit of the value of the current density permitted by the particular permselective membrane utilized) and at cell voltages ranging from about 1 to 20, preferably from about 1 to about 10, volts to produce the tin metal.

The temperature of the catholyte during production of the tin metal may be from the freezing point of the solution up to about 40° C. but typically is about 5° C. to about 40° C., preferably from about 25° C. to 35°. The maximum permissible temperature may vary according to the particular electrolyte but should not be so high as to encourage dissolution of the tin deposit by the electrolyte in the cathode compartment utilized. The temperature of the anolyte may fall within the same range as given for the catholyte and preferably is within about 5° C. of the catholyte temperature.

The anolyte, i.e., the electrolyte in the anode compartment, may be any aqueous solution of a compatible electrolyte material. Typically, the anolyte will be a mineral acid solution or a tin salt thereof. A limitation on the utilization of a material as the anolyte arises from two factors. That is, as described hereinbelow, the utilization of a particular material generally results in the production of an oxidizing gas which must be removed from the electrolytic cell during processing in order to achieve the desired results. The toxicity of the produced gas and/or economics of the overall process may dictate the utilization of a particular material as the anolyte. For example, the use of nitric acid may result in the production of gaseous nitrous oxides in the anode compartment which are toxic and difficult to control. Thus, the utilization of nitric acid is not normally preferred unless such gaseous by-products are desired for other purposes. In another instance, the utilization of hydrochloric acid as the electrolyte will result in the production of chlorine gas in the anode compartment which gas while also toxic may be useful in certain processes for other purposes. Thus, hydrochloric acid may be more acceptable economically as the anolyte material. Hydrohalous acids are one of the preferred groups of anolyte electrolyte materials. Sulphuric acid may also be utilized as the anolyte and in such case oxygen will be the produced gas resulting from the electrolysis of water. Since oxygen presents no toxicity problems, sulphuric acid is one of the other preferred embodiments of the presently claimed invention. Tin salts of any suitable acid may also be used. While other metallic salts of these acids are theoretically utilizable, the presence of other metallic cations in the anode compartment could result in the transference of these other metal cations into the cathode compartment and thus into the tin deposit being produced therein. Ordinarily, these other metal cations are not desired in the deposited tin and it is thus preferred that when metal salts are used in the anolyte, that the stannous salts of these particular acids be utilized. When a multi-permselective membrane configuration is used (such as shown in FIG. 2), the use of these other metal salts, the metal cations of which do not transfer through an anionic membrane, may be possible. Typically, the concentration of the acid or salt solution ranges from about 2 to about 50% free acid or salt by weight of the anolyte solution.

The catholyte, i.e., the electrolyte in the cathode compartment, may be any aqueous solution containing stannic ions, stannous ions or mixtures thereof in a suitable electrolyte which is generally a mineral acid solution such as sulfuric acid, hydrochloric acid, or mixtures thereof or fluoroboric acid or the like. In the case of stannic anion-containing solutions which are available from various commercial processes (e.g., acid plating baths or the like) the solution contains an excess of acid relative to the amount necessary to form the stannic acid salt. For example, stannic chloride has the typical formula $SnCl_4$. In commercial stannic chloride manufacturing processes (other than those for the production of anhydrous stannic chloride) a small amount of excess hydrochloric acid is generally added to stabilize stannic chloride such that the ratio of chloride to tin in the stannic chloride solution is greater than 4, generally 4.5 to 1. In certain chemical processes (e.g., acid plating baths or the like), the ratio of chlorine to tin in the stannic chloride-containing solutions may be as high as about 6 to 1 or higher. It has been found that under such circumstances when the chlorine is present in excess amount that the tin and chloride ions form anionic complexes, e.g., $SnCl_6^{--}$ or $SnCl_5^{-}$. At high acid contents, the stannic salt may form a tin acid, e.g., hydrochlorostannic acid or hydrochlorostannous acid. These complexes may also be considered as $SnCl_4.2HCl$ or $SnCl_2.HCl$, respectively. While the exact nature of these components has not been conclusively established, it has been found that, under these circumstances, the tin and chloride ions act as anionic complexes in solution in the electrolysis process of the present invention. Even if a stoichiometric stannic chloride solution is available, hydrochloric acid may be added thereto to obtain the desired ratio of chlorine to tin greater than 4 to 1.

Often, the feed stocks which may be utilized in the electrolysis process of the present invention are those which have been produced in various other chemical processes and which may contain minor and/or substantial amounts of various impurities. In such cases, it may be desirable to remove these impurities prior to introduction into the cathode compartment by various purification techniques including oxidation or reduction (for example, by contact with oxygen or chlorine gases) or by contact of the solution with various adsorbents or ion exchange materials to remove specific impurities contained therein. It is also possible to concentrate the solution prior to introduction into the electrolysis cell, for example, to a concentration up to about 60% of the tin salts by weight of the solution. If the feedstock contains tin in an insoluble form, e.g., a slurry of hydrated stannic oxide, the feedstock should be treated (acidulated with HCl, for example) either prior to electrowinning or concurrently therewith to solubilize the tin values.

It should be recognized that the electrowinning (or electrodepositing) of the tin metal from the catholyte itself is a purification of the tin. For example, it has been found that any iron or titanium impurities (e.g., ferric or ferrous chloride or titanium chloride) will remain in the catholyte while the tin is being deposited on the cathode. It has similarly been found that various organic impurities may also be separated from the tin values utilizing the process of the present invention. It is within the scope of this invention to repeat the electrolytic process of the present invention by converting the purified tin to a purified tin salt (as explained hereinbelow) which salt may then be used as the catholyte feedstock in the next run. In this manner, each succeeding electrolytic reduction results in an increased purification of the tin metal (and concommitantly the tin salt produced therefrom).

In general, any type of cation permselective membrane may be used which will substantially exclude or prevent tin anions from passing from the anode compartment to the cathode compartment of the electrolytic cell, but which will allow passage of cations (including protons from the anolyte) therethrough.

Typically, the cation permselective membrane is a cation exchange membrane or sheet which is substantially impermeable to the aqueous electrolyte. These cation exchange membranes are well known per se and include both membranes where ion exchange groups or material are impregnated in or distributed throughout a polymeric matrix or binder, as well as those where such groups are associated only with the outer surface of a membrane backing or reinforcing fabric. Continuous ion exchange membranes, in which the entire membrane structure has ion-exchange characteristics and which may be formed by molding or casting a partially polyermized ion exchange resin into sheet form, may also be used.

For example, the ion exchange material may include material to which acid groups such as $—SO_3H$ or —COOH are added to a polystyrene resin by conventional procedures. In the alternative, the groups may be added by contacting the surface to be coated with a reactant, the molecular structure of which leaves exposed to the surface thereof ion exchange groups of the same type as those found upon the surfaces of cation exchange membranes, e.g., $—SO_3H$ or —COOH moieties. In certain of the commercial available membranes, the polymers are fluorinated alkyl sulfonic acid polymers.

Widely known cation exchange membranes may be prepared by copolymerizing a mixture of ingredients, one of which contains a substituent or group which is acid in nature and which may comprise the sulfonic acid group or the carboxylic acid group. Thus, this ionizable group may be attached to a polymeric compound such as copolymers of styrene and divinyl benzene, polystyrene phenolaldehyde resins, resorcinol-aldehyde polymers, copolymers of divinyl benzene with acrylic acid, copolymers of divinyl benzene with maleic anhydride, copolymers of divinyl benzene with acrylonitrile, copolymers of divinyl benzene and methacrylic acid, cellulose derivatives such as regenerated cellulose, ethyl cellulose and polyvinyl alcohol, and like polymers containing free hydroxyl groups, which are reacted with sulfonating agents, and polyethylene reacted with chlorosulfonic acids or other sulfonating agents.

In general, any type of anion permselective membrane may be used which will substantially exclude or prevent the cations from passing from the anode compartment to the cathode compartment of the electrolytic cell. Typically, the anion permselective membrane is an anion exchange membrane or sheet which is substantially impermeable to the aqueous electrolyte. These anion exchange membranes are well known per se and include both membranes where ion exchange groups or material are impregnated in or distributed throughout a polymeric matrix or binder, as well as those where such groups are associated only with the outer surface of a membrane backing or reinforcing fabric. Continuous ion exchange membranes, in which the entire membrane structure has ion-exchange characteristics and which may be formed by molding or casting a partially polymerized ion exchange resin into sheet form, may also be used.

For example, the ion exchange material may include material to which basic groups such as ordinary ammonium radicals are added to as polystyrene resin by conventional procedures. In the alternative, the groups may be added by contacting the surface to be coated with a reactant, the molecular structure of which leaves exposed on the surface thereof ion exchange groups of the same type as those found upon the surfaces of anion exchange membranes, e.g., ordinary ammonium radicals.

Widely known anion exchange membranes may be prepared by copolymerizing a mixture of ingredients, one of which contains a substituent or group which is basic in nature and which may comprise amine groups, ordinary ammonium groups, the guanidine group, the dicyandiamine group and other nitrogen-containing basic groups. Thus, this ionizable group may be attached to a polymeric compound such as phenolformaldehyde resin, a styrene-divinyl benzene copolymer, a urea-formaldehyde resin, a melamine-formaldehyde resin, a polyalkylene-polyamine-formaldehyde resin or the like.

The preparation of these ion exchange membranes are well known in the art and for sake of brevity are not further described herein; for more detailed information, reference may be made to U.S. Pat. Nos. 2,636,851, 2,681,319, 2,681,320, 2,723,229, 2,730,768, 2,832,728, 3,113,911, 3,356,607 and 3,480,495, all of which are incorporated herein by reference.

Typically, these ion exchange membranes are reinforced, i.e., have a backing consisting of a sheet of a relatively inert material, as for example, glass having a woven or mesh structure. Other known backings include woven and non-woven fabrics of materials such as asbestos, polyesters, polyamides, acrylics, modacrylics, ceramic or glass fibers, vinylidene chloride, rayons, polypropylene, polytetrafluoroethylene and the like. Fabrics or backings made of mixtures of two or more of these materials may also be used in the present invention.

The thickness of the ion permselective membrane is not particularly critical, but will of course depend on the particular operating conditions. In general, suitable membranes may be as thin as 20,000th of an inch to as much as ½ inch thick. The minimum thickness of a membrane will also depend on the total thickness of the supporting structure. Although the thicker membranes have a longer useful life, their electrical resistances increase proportionally to their thickness, so that if the membrane is made increasingly thicker, a value will be obtained for which the resistance is too great for practical use.

Typical commercially available ion exchange membranes include those available from Ionics Incorporated, Watertown, Mass.; from Ionac Chemical Company, Birmingham, N.J., under the trade name "Ionac"; from AMF Incorporated of New York, N.Y., under the trade name "AMFion" and from E. I. duPont de Nemours & Co. (Inc.) under the trade name "Nafion".

The present process may be conducted on a batch, semi-continuous or continuous basis and at atmospheric, super-atmospheric or sub-atmospheric pressures but typically is run at atmospheric pressure. The present invention is particularly useful in the recovery of tin from stannous chloride streams used in commercial processes which produce stannic chloride streams as a result of a particular treatment. As described hereinbelow, with re-chlorination of the tin, a regeneration or replenishment of the stannous chloride streams may be affected with a minimum addition of tin (although tin or stannous chloride may be added to the stream as make up in appropriate situations).

When hydrochloric acid is utilized as the anolyte solution, chlorine gas is liberated at the anode. Since chlorine is toxic, it is necessary to remove the chlorine gas which is evolved. For this purpose, a vacuum tube or other means 17 are provided in the anode compartment 23 or compartment 22 as described before. When sulphuric acid is utilized as the anolyte medium, oxygen gas is evolved. The particular gas which is evolved will depend on the particular electrolyte material which is used in the anolyte and the choice of the electrolyte material will depend upon the utilization of the process and the type of by-product gas which is desired or which poses the least amount of problems for collection and disposal. Different anolyte materials may be used to effectuate the production of different gases.

It is also possible to utilize the anolyte compartment 23 to manufacture a tin chemical while tin is being produced in the cathode compartment 22. That is, while tin is being deposited on the cathode from the tin-containing solution in the cathode compartment, it is possible to produce stannous sulfate (or chloride) in the anode compartment using sulfuric acid (or hydrochloric acid) as the anolyte and a soluble tin electrode. In such a process, means to remove the anolyte material and replenish the soluble electrode during operation may be provided or the process may be conducted as a batch process with removal of the anolyte and catholyte solutions after the anode has been completely dissolved. Other tin chemicals may be manufactured in the anolyte solution in the same manner by the appropriate selection of the electrolyte of the anode compartment. It is also possible to utilize a basic process in the anode compartment, for example, using alkali metal hydroxide solution and a soluble tin anode to form alkali metal stannate or even a stannic oxide sol product.

As mentioned above, the electrowinning process of the present invention may be utilized to form tin salts of the same purity as the deposited tin. While it is known to form some tin salts in the anode compartment of an electrolytic cell separated from the cathode compartment by an anionic permselective membrane (see U.S. Pat. No. 3,795,595), the process of the present invention can form certain salts with the cationic permselective membrane and can be used to purify and regenerate tin-containing solutions without adding tin metal.

To form stannous chloride, for example, the catholyte solution 15 is removed from the cathode compartment 22 of the electrolytic cell 12 after electrowinning of the tin metal onto the cathode 11 and replaced with a hydrochloric acid solution. If the desired tin salt as the same acid moiety as that in the original catholyte solution, the catholyte 15 may be purified, for example, by distillation, contact with ion exchange resins, adsorbents or the like, in purification step 20 and recycled to the cathode compartment 22. The stannous chloride is formed by reversing the polarity of the direct electric current imposed previously, that is, making cathode 11 the anode 11 in this step. Chlorine is liberated from the hydrochloric acid and reacts with the tin previously deposited on the cathode (now anode) 11 to form stannous chloride in the presence of hydrochloric acid.

Other tin salts, such as stannous sulfate, which exist predominantly in the cationic form in acid solution may effectively be formed utilizing the electrolytic cell of FIG. 2. The catholyte 15' is replaced with a sulfuric acid solution. When the current is reversed, making the cathode 11' now the anode 11' oxygen is liberated forming a tin oxide or tin oxide film which is digested (reacted) with the sulfuric acid solution. The oxygen also depassivates the tin metal surface making the reaction to the stannous sulfate easier.

Since stannous sulfate exists predominantly in cationic form in acid solution, the anionic permselective membrane 21' is utilized to prevent transfer of the cations to the other (now cathode) compartment. Oxygen contact may detrimentally affect anionic permselective membranes so the cationic permselective membrane 13'' may be used to prevent any such oxygen contact from the now-anode compartment 22'. In addition, the multiple cationic permselective membranes 13' and 13'' may be used to effect partition of various disparate materials within a given electrolytic cell.

The electrolysis conditions in this tin salt-forming step are essentially the same as those in the electrowinning step although it is preferred that the temperature of this step be somewhat higher, e.g., from about 20° C. up to the boiling point of the solution and, typically up to about 75° C., preferably up to about 40° C.

The catholyte 16 (or 16',16'') can be any of the electrolytes mentioned previously as useful as anolyte 16 (or 16', 16'') in the electrowinning step. Since this material is not being depleted in the first step (except for the evolution of halogen gas from hydrohalous acids) reconstitution is not usually necessary. Replenishment of hydrohalous acids is also usually not necessary unless the strength of the acid is insufficient for it to function as an electrolyte.

If desired, the tin deposited in the electrowinning step may be washed by introduction of distilled water into the electrolytic cell prior to introduction of the salt-forming acid solution.

The present invention is further illustrated by the following Examples: All parts, percentages and ratios in the examples, as well as in other parts of the specification and claims are by weight unless otherwise specified.

EXAMPLE I

An acidified stannous chloride solution having the following parameters was electrolytically reduced at 8.0 amps held constant during the indicated time interval. A carbon electrode was employed for the cathode and a platinum cylinder for the anode. The submerged area of each was about the same as that of the membrane. The anolyte used was 10% $H_2SO_4$. Operating current density was 195 amps/ft$^2$. Anolyte and catholyte temperatures were about 24° C.

TABLE 1

Starting Solution Data:

| | | |
|---|---|---|
| Total tin | = | 96.98 g/l |
| Stannous tin | = | 95.42 g/l |
| Molar ratio Cl/Sn | = | 5.54 |

Electrolysis Data

| Electrolysis Time, Amp. Hr. | Stannous Tin Content, g/l Catholyte | Anolyte | Current Efficiency, % |
|---|---|---|---|
| 0 | 95.42 | — | — |
| 20 | 15.85 | — | 89.5 |
| 22.5 | 7.07 | — | 88.3 |
| 25 | 1.02 | 0.04 | 86 |

Current efficiency is determined in accordance with the following equation:

$$\left(\text{Faraday constant } \frac{0.45 \text{ Amp.-hrs}}{\text{g}} \times \text{Actual g. tin plated out}\right) / \text{Actual Amp. hrs.} \times 100$$

Although the run was stopped after 25 amp. hrs., it is believed, based on other work done, that further tin recovery could have been obtained by further electrowinning. The yield after 25 amp. hrs. was 98.93%. The tin was deposited on the cathode and had extended from the cathode to the cationic permselective membrane (Nafion 417-duPont Co.-an alkyl fluoronated sulfonic acid polymer membrane) without detrimentally affecting the process. As the tin was being removed from the solution and being deposited on the cathode (in effect making the surface area of the cathode larger), the evolution of hydrogen at the cathode increases.

EXAMPLE II

The electrolytic cell of Example I was used to reduce a stannic chloride solution containing iron impurities. The solution was reduced at a constant amperage of 8.8 amps, a current density of 146 amps/ft$^2$ and a cationic membrane (Nafion 417) of 0.067 ft$^2$. The anolyte was 10% $H_2SO_4$. Temperature of both anolyte and catholyte was about 24° C.

TABLE 2

Starting Solution Data:

| | | |
|---|---|---|
| Total Tin | = | 119.75 g/l |

TABLE 2-continued

| | | |
|---|---|---|
| Stannic Tin | = | 119.75 g/l |
| Molar ratio Cl/Sn | = | 6.025 g/l |
| Total Fe | = | 210 mg/l |

Electrolysis Data

| Electrolysis Time, Amp.-hr. | Total Tin Content, g/l | Catholyte Stannous Tin Content, g/l | Fe Content, mg/l |
|---|---|---|---|
| 0 | 119.75 | 0 | 210 |
| 30 | 100.02 | 57.76 | — |
| 60 | 51.50 | 49.86 | — |
| 70 | — | 28.37 | — |
| 80 | — | 4.79 | — |
| 81.77 | — | 2.99 | — |
| 85 | 0.34 | 0.30 | 175 |

The run was stopped after 85 amp. hrs. with tin deposited on the cathode. The anolyte showed 0 total tin and 1.8 mg/l Fe. This data shows that the process of the present invention effectively reduced the stannic form of the tin through the stannous form to tin metal while retaining essentially all of the iron in solution. Current efficiency after 85 amp.-hrs. was 88.1%.

EXAMPLE III

The procedure of Example II was repeated using a glass plant sludge containing not only hydrated stannic oxide but also titanium and iron impurities. Prior to introduction into the electrolytic cell, the glass plant sludge was treated to remove ammonium chloride, filtered, digested in concentrated HCl to form stannic chloride and filtered.

The tin was deposited on the cathode with essentially all of the iron and other impurities remaining in solution as shown in the following Table.

TABLE 3

| Element | Amount in Original Solution | | Amount in Electrowinned Tin, wt. percent |
|---|---|---|---|
| Sn | 1.68 | g/l | 98.8 |
| Fe | 160 | mg/l | 0.0019 |
| Ti | 86 | mg/l | 0 |
| Al | 18 | mg/l | 0 |
| Pb | 2 | mg/l | 0 |
| Sb | 0 | mg/l | 0 |
| Ni | 1.7 | mg/l | 0.0019 |
| Cr | 0.9 | | 0.0009 |
| Si | 14 | mg/l | 0 |
| Cu | 0 | mg/l | 0.0019 |

The difference in the total above analysis and 100% may be due to adsorbed hydrogen and/or water.

EXAMPLE IV

The electrolytic cell of Example I was used to deposit tin metal from a stannous fluoroborate solution at 8 amp.

Electrolysis Data:

| Electrolysis Time, Amp.-hr. | Catholyte Total Tin Content, g/l | Catholyte Stannous Tin Content, g/l |
|---|---|---|
| 0 | 64.99 | 64.09 |
| 10 | — | 20.98 |
| 14 | — | 4.53 |
| 16 | 1.53 | 0.37 |

The electrowinned tin was analyzed at 99.5% purity.

EXAMPLE V

The electrolytic cell of Example I is used to reduce tin from a stannic chloride solution originally containing not only mixed iron and other metallic impurities but also methylated phenol or mixed tocophenol types organic impurities. In other runs, the organic impurities were noted to slightly reduce the current efficiency (e.g. to about 80% current efficiency). In this Example, the starting material was first contacted with chlorine gas and then with XAD-4 adsorbent to remove much of the organic impurities.

Electrolysis was conducted to anolyte (10% $H_2SO_4$) and catholyte temperature of about 24°-27° C., and a starting amperage of 6.2 which was increased during the run to an ending amperage of 9.8.

TABLE 5

Electrolysis Data:

| Electrolysis Time, Amp. Hr. | Catholyte Total Tin Content, g/l | Catholyte Stannous Tin Content, g/l | Fe Content mg/l | Molar Cl/Sn |
|---|---|---|---|---|
| 0 | 103.06 | 0 | 2850 | 6.20 |
| 62 | — | 7.89 | 2400 | |
| 66 | — | 0.23 | 2400 | |
| 70 | — | 122 mg/l | 2200 | |
| 75 | — | 50 mg/l | 2300 | |
| Run stopped at 75 Amp.-hr., analysis 10 min. after current stopped | | 265 mg/l | 2200 | |

A sample of the tin deposit was removed after 50 Amp.-hrs., water-washed, methanol rinsed and vacuum dried. Analysis of this deposit and of the ending catholyte (taken 10 min. after current stopped) was as follows:

| Element | Tin Deposit, wt. percent | Ending Catholyte mg/l |
|---|---|---|
| Sn | 99.1 | 265 |
| Fe | 0.0032 | 2300 |
| Pb | 0 | 4 |
| As | 0 | 0 |
| Sb | 0 | 0 |
| Cu | 0.0016 | 0 |
| Ni | 0 | 4.9 |
| Na | 0.0063 | 29 |
| Mg | 0.0005 | 15 |
| Ca | 0.0016 | 31 |

The catholyte solution was removed and the cathode compartment and cathode triple-washed with distilled water. The cathode compartment (15 in FIG. 1) was refilled with 5 M HCl. The electric current was reversed making electrode 11 the anode and the 5 M HCl solution the anolyte. Electrolysis was conducted at 9 amps for 30 hrs. to form a stannous chloride solution.

Electrolysis Data:

| Electrolysis Time, Amp.-hrs. | Anolyte Total Tin Content, g/l | Anolyte Stannous Tin Content, g/l |
|---|---|---|
| 0 | 0 | 0 |
| 10 | 33.71 | 31.9 |
| 20 | 61.25 | 54.33 |
| 30 | 81.12 | 65.41 |

After 30 Amp.-hrs., the current was turned off and the solution stirred for 1½ hrs. at room temperature. Because the data indicated a high degree of stannic tin (as shown by the difference in total tin content less stanous tin content), the current was reversed again to the original polarity and electrolytically steeped for 5 amp.-hrs. resulting in the final analysis of 76.45 g/l total tin content and 73.44 g/l stannous tin content. The stannous chloride product is recoverable from the solution by conventional filtering (to remove any residual tin metal particles), vacuum concentration and precipitation steps.

EXAMPLE VI

The electrolytic cell of Example I was used to reduce a stannic chloride-containing feed stock essentially similar to that used in Example V. The cell was configured as a FIG. 2 utilizing two Nafion 417 cationic permselective membrane (13' and 13'') and one MA-3475 (Ionics, Inc.) anionic permselective membrane (21'). The anolytes 16' and 16'' in each instance were 10% $H_2SO_4$. The amperage was 6 amps.

The starting catholyte contained 62.58 g/l total tin and 180 mg/l Fe with a molar Cl/Sn ratio of 7.56. After 32 amp. hrs., the catholyte analyzed less than 0.04 g/l total tin and 160 mg/l Fe.

The spent catholyte (after the 32 amp. hrs. run) was distilled at 1 atmosphere pressure and a temperature of about 100°–110° C. to purify and recover the hydrochloric acid. The distillate was analyzed and showed 5 mg/l Sn, 1 mg/l Ti and 2 mg/l Fe.

After the tin deposit and cathode compartment 22' were washed three times with distilled water, the compartments were filed with one-half liter of a 20% $H_2SO_4$ solution. Temperature of the electrolytes were about 27° C. There were 31.3 g. of tin deposited on the electrode 11'. The current was reversed so that electrode 11' was now the anode.

TABLE 6

Electrolysis Data:

| Electrolysis Time Amp. Hrs. | Anolyte Total Tin Content, g/l | Anolyte Stannous Tin Content, g/l |
|---|---|---|
| 0 | 0 | 0 |
| 7.1 | 29.11 | 28.76 |
| 13 (anolyte 15') | 49.77 | 46.34 |
| (anolyte 15'') | 14.90 | 14.24 |
| (catholyte 16') | 0.04 | — |
| (catholyte 16'') | 0.12 | 0.04 |

During the run, 10% $H_2SO_4$ solution was added at 6.25, 9 and 12 amp. hrs. to replenish the solution 16'' in the anolyte compartment.

Since the solutions contained a number of small particles of tin metal (apparently remaining from the tin on electrode 11' and not re-solubilized), the anolytes 15' and 15'' were mixed, held overnight at room temperature, steeped for one hour at 70° C. and electrolytically steeped (4 amp. hr. at 1 amp., 6.9 v, 67° C.) in an attempt to reduce all stannic ions to stannous ions. The resulting solution was filtered to remove any residual metallic tin and vacuum concentrated to precipitate the stannous sulfate product which analyzed as follows:

| | | |
|---|---|---|
| Total Tin | = | 51.88 w/o |
| Stannous Tin | = | 51.50 w/o |
| Free $H_2SO_4$ | = | 2.28 w/o |
| Chloride | = | 0 |
| Water | = | Balance |

The sulfuric acid solution from which the stannous sulfate product was recovered was analyzed as follows:

| | | |
|---|---|---|
| Total Tin | = | 8.24 g/l |
| Stannous Tin | = | 8.22 g/l |
| Chloride | = | 1.77 g/l |

The chloride in the anolyte is believed to be the result of chlorine desorbing from the carbon electrode during resolubilization which chlorine had been absorbed during electrowinning. This could be avoided by using a non-porous (e.g., tin) electrode.

The stannous sulfate obtained above was used in a tin electroplating bath and was found to perform in the same manner as commercially available stannous sulfate.

EXAMPLE VII

The procedure of Example VI was repeated except that a soluble tin anode 10' was used. While tin was being deposited on cathode 11', the tin anode 10' was reacting with the sulfuric acid solution 16' to form stannous sulfate which was recovered as above from anolytes 16' and 16''. The tin metal deposited on the cathode 11' was then recovered.

EXAMPLE VIII

The procedure and feedstock of Example III was repeated except that 20% $H_2SO_4$ was used as the anolyte and that the glass plant sludge was not pre-treated to remove ammonium chloride nor was the sludge digested in concentrated HCl.

Upon electrolysis of the sludge slurry, it was found necessary to add concentrated HCl to solubilize the tin apparently as stannic chloride, ammonium chlorostannate and/or hydrochlorostannic(ous) acid. The tin was concommitantly deposited on the cathode in the manner of Example III with high yield (93%) and current efficiency (71%). Thus, the processing time of this material is substantially shortened over the pre-treatment process.

The principles, preferred embodiments and modes of operation of the present invention have been described in the foregoing specification. The invention which is intended to be protected herein however is not to be construed as limited to the particular forms disclosed, since these are to be regarded as illustrative rather than restrictive. Variations and changes may be made by those skilled in the art without departing from the spirit of the present invention.

I claim:

1. An electrolytic process for the production of tin or tin salts in an electrolytic cell, comprising an anode compartment and a cathode compartment, each compartment containing an electrolyte solution, and a cationic permselective barrier between the anode and cathode compartments comprising introducing a soluble tin salt or tin acid into the cathode compartment of the electrolytic cell, applying direct current to the anode and cathode to produce tin on the cathode in the cathode compartment while substantially simultaneously preventing migration of anions between the cathode and anode compartments and allowing migration of protons from the anode to cathode compartments by maintaining an electrolyte fluid impermeable cationic permselective barrier between the anode and cathode, removing produced gas from the anode compartment and removing the tin or tin salts from the cathode compartment.

2. A process of claim 1 in which the electrolyte in the anode compartment is a mineral acid.

3. A process of claim 2 wherein the mineral acid is sulfuric acid.

4. The process of claim 1 wherein said tin is produced at a temperature between the freezing point of the solution and about 40° C.

5. The process of claim 1 in which the tin salt introduced into the cathode compartment is stannic chloride.

6. The process of claim 5 wherein said stannic chloride is obtained from a starting material of glass plant sludge, blue sludge, detinning mud, plating baths, spent catalyst systems, drosses, ores and ore residues.

7. The process of claim 6 wherein the starting material is acidulated with HCl to form stannic chloride and/or remove impurities.

8. The process of claim 5 wherein the ratio of chlorine ions to tin ions in the material introduced into the cathode compartment of the electrolytic cell is at least about 4 to 1.

9. The process of claim 8 wherein the catholyte is hydrochloric acid.

10. A process of claim 1 in which the anode and cathode are of inert materials.

11. A process of claim 1 in which the anode and/or cathode is made of tin.

12. A process of claim 1 wherein the catholyte is removed after substantially all of the tin originally contained therein has been deposited on the cathode, an acid solution having the desired tin salt moiety is provided in the said cathode compartment and direct current is applied to the said anode and cathode compartments in opposite polarity to that previously applied to produce the said tin to thereby electrolytically form a tin salt.

13. The process of claim 12 wherein the original cathode is formed of tin.

14. The process of claim 12 wherein said tin salt is formed at a temperature of from about 20° C. up to the boiling point of the solution.

15. The process of claim 13 wherein the said anolyte is sulfuric acid, the soluble tin salt is stannous chloride, stannic chloride or mixtures thereof, the said acid solution is hydrochloric acid and the formed tin salt is stannous chloride.

16. A process of claim 8 wherein the catholyte is removed after substantially all of the tin originally contained therein has been deposited on the cathode, an acid solution having the desired tin salt moiety is provided in the said cathode compartment and direct current is applied to the said anode and cathode compartments in opposite polarity to that previously applied to produce the said tin thereby electrolytically forming tin salt.

17. The process of claim 15 wherein the hydrochloric acid in the catholyte is removed from the cathode compartment of the electrolytic cell, purified and returned to the electrolytic cell as the said acid solution.

18. The process of claim 17 wherein the hydrochloric acid is purified by distillation, adsorbants or ion exchange resins.

19. An electrolytic process for the production of stannous chloride or stannous sulfate utilizing an electrolytic cell comprising a cathode and an anode and an ion permselective barrier dividing the electrolytic cell into anode and cathode compartments which process comprises providing a mixture of stannic and chloride ions having a chloride to tin ratio of at least about 4:1 in the cathode compartment, providing a mineral acid solution in the cathode compartment, applying direct current to the anode and cathode to form tin which is deposited on the cathode and substantially preventing migration of stannous and/or stannic ions from the cathode compartment to the anode compartment while simultaneously allowing migration of protons from the anode to cathode compartments by maintaining a cationic permselective barrier between the anode and cathode, removing the spent catholyte solution from the cathode compartment, introducing a hydrochloric acid or sulfuric acid solution into the said cathode compartment and applying direct current to the said anode and cathode compartments in opposite polarity from that previously applied to form stannous chloride or stannous sulfate.

20. The process of claim 19 wherein the mineral acid solution in the cathode compartment is either hydrochloric acid or sulfuric acid, the acid solution is removed, purified and returned to the said cathode compartment to form the tin salt thereof.

21. The process of claim 20 wherein the mineral acid is purified by distillation, adsorbants or ion exchange resins.

22. The process of claim 19 wherein the electrolytic cell further contains an anionic permselective membrane between the anode and cathode.

23. The process of claim 22 wherein the electrolytic cell contains two cationic permselective membranes and the anionic permselective membrane is disposed therebetween.

24. An electrolytic process for the production of tin and tin chemicals in an electrolytic cell, comprising an anode compartment and a cathode compartment, each compartment containing an electrolyte solution, at least the anode compartment containing a tin anode and a cationic permselective barrier between the anode and cathode compartments comprising introducing a soluble tin salt or tin acid into the cathode compartment of the electrolytic cell, applying direct current to the anode and cathode to produce tin on the cathode in the cathode compartment and to react the tin anode with the electrolyte in the anode compartment to form tin chemicals therein while substantially simultaneously preventing migration of anions between the cathode and anode compartments and allowing migration of protons from the anode to cathode compartments by maintaining an electrolyte fluid impermeable cationic permselective barrier between the anode and cathode.

25. The process of claim 24 in which the electrolyte in the anode compartment is a mineral acid.

26. The process of claim 25 wherein the mineral acid is hydrochloric acid.

27. The process of claim 24 wherein the electrolytic cell further contains an anionic permselective membrane between the anode and cathode.

28. The process of claim 27 wherein the mineral acid is sulfuric acid.

29. The process of claim 27 wherein the electrolytic cell contains two cationic permselective membranes and the anionic permselective membrane is disposed therebetween.

30. The tin metal product of the process of claim 1.

* * * * *